US006688992B2

(12) United States Patent
Takemura et al.

(10) Patent No.: US 6,688,992 B2
(45) Date of Patent: Feb. 10, 2004

(54) GOLF BALL

(75) Inventors: Kohei Takemura, Kobe (JP); Seigo Sakagami, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 164 days.

(21) Appl. No.: 09/935,594

(22) Filed: Aug. 24, 2001

(65) Prior Publication Data

US 2002/0045501 A1 Apr. 18, 2002

(30) Foreign Application Priority Data

Aug. 24, 2000 (JP) ..... 2000-253753
Oct. 23, 2000 (JP) ..... 2000-322731

(51) Int. Cl.[7] ..... A63B 37/12
(52) U.S. Cl. ..... 473/378; 473/365; 473/385
(58) Field of Search ..... 473/363, 365, 473/372, 357, 377, 378, 385, 354, 360, 362

(56) References Cited

U.S. PATENT DOCUMENTS 4,955,966 A * 9/1990 Yuki et al. ..... 473/357
5,716,293 A 2/1998 Yabuki et al.
5,935,021 A 8/1999 Kashiwagi et al.

FOREIGN PATENT DOCUMENTS

| | | |
|---|---|---|
| JP | A6264378 | 3/1987 |
| JP | A639461 | 1/1988 |
| JP | A1223980 | 9/1989 |
| JP | A10108923 | 4/1998 |
| JP | A10179802 | 7/1998 |
| JP | A10305115 | 11/1998 |

* cited by examiner

*Primary Examiner*—Paul T. Sewell
*Assistant Examiner*—Tom P Duong
(74) *Attorney, Agent, or Firm*—Birch, Stewart, Kolasch & Birch, LLP

(57) ABSTRACT

A golf ball superior in resilience performance, cut resistance and spin performance is provided. The golf ball is composed of a core and a cover surrounding the core. The cover is formed of a composition having 0.5–20 parts by weight of organic short fiber blended with respect to 100 parts by weight of a polymer component having thermoplastic elastomer as its main component. Thermoplastic resin may also be blended in the polymer component. The cover composition has a flexural rigidity of 80–300 MPa, and the cover surface has a Shore D hardness of 41–56.

7 Claims, No Drawings

GOLF BALL

BACKGROUND OF THE INVENTION

1. Field of the Invention

The present invention relates to golf balls, and more particularly, to a golf ball exhibiting good spin performance with its easiness to control spin rate when hit with an iron club, and excellent in cut resistance, while maintaining good resilience performance.

2. Description of the Background Art

Conventionally, a golf ball obtained by forming a thread-wound layer around a liquid center and enveloping it with a balata cover has been widely used by skilled golfers and professional golfers, because of its superiority in hit feeling and controllability. The structure of the golf ball, however, requires a complicated manufacturing process and the golf ball itself is inferior in cut resistance. Thus, various kinds of soft covers have recently been proposed to replace the balata cover.

For example, Japanese Patent Laying-Open No. 10-179802 discloses a golf ball wherein resin as a base material of the cover is chiefly composed of a heated mixture of ionomer resin and styrene-butadiene-styrene block copolymer having a polybutadiene block containing epoxy group or styrene-isoprene-styrene block copolymer having a polyisoprene block containing epoxy group. Flexural rigidity of the composition constituting the cover is from 50 MPa to 300 MPa, and Shore D hardness is from 40 to 60. With this technique, improvement in hit feeling, spin performance and flying performance is expected. However, there still is room for improvement in cut resistance.

U.S. Pat. No. 5,716,293 discloses a golf ball that is formed of a solid rubber center containing an oily material and a soft cover material to improve the hit feeling and increase the spin rate when hit with a short iron club.

This however uses oil-resistant rubber and ionomer resin of great hardness around the solid rubber center. Therefore, resilience performance and the hit feeling have yet to be improved.

U.S. Pat. No. 5,935,021 discloses a golf ball wherein fibrous aluminum borate whisker is blended into a cover material mainly composed of thermoplastic resin or thermoplastic elastomer to improve resilience performance, durability and cut resistance. With this technique, however, the whisker blended into the cover material deteriorates the resilience performance thereof.

SUMMARY OF THE INVENTION

An object of the present invention is to provide a golf ball superior in resilience performance, cut resistance and spin performance.

The golf ball of the present invention is composed of a core and a cover surrounding the core, and the cover is formed of a cover composition having organic short fiber blended in a polymer component including thermoplastic elastomer as its main component.

Preferably, the thermoplastic elastomer is one of styrene type thermoplastic elastomer and urethane type thermoplastic elastomer.

Thermoplastic resin such as ionomer resin may be blended in the polymer component of the cover composition, in a blended amount of less than 50 parts by weight with respect to 100 parts by weight of the polymer component.

Preferably, the blended amount of the organic short fiber is 0.5–20 parts by weight with respect to 100 parts by weight of the polymer component including the thermoplastic elastomer and possibly the thermoplastic resin or the like.

Still preferably, the cover composition of the present invention is set to have a flexural rigidity of 80–300 MPa and a Shore D hardness at the cover surface of 41–56.

The foregoing and other objects, features, aspects and advantages of the present invention will become more apparent from the following detailed description of the present invention.

DESCRIPTION OF THE PREFERRED EMBODIMENTS

The golf ball of the present invention is composed of a core and a cover enveloping the core. The cover is formed of a composition including thermoplastic elastomer as a polymer component.

The thermoplastic elastomer for use in the present invention may be any of styrene type thermoplastic elastomer, urethane type thermoplastic elastomer, ester type thermoplastic elastomer, olefin type thermoplastic elastomer, and amide type thermoplastic elastomer.

The styrene type thermoplastic elastomer is a block copolymer having a soft segment and a hard segment within a molecule. The soft segment is a unit of, e.g., butadiene block or isoprene block that is obtained from conjugated diene compound. Here, as the conjugated diene compound, one or at least two of butadiene, isoprene, 1,3-pentadiene, 2,3-dimethyl-1,3-butadiene and others can be selected. Among them, butadiene, isoprene and a combination thereof are preferable. The component constituting the hard segment is a unit of styrene block, for example, that is obtained from a compound having one or at least two types selected from styrene and its derivatives, e.g., α-methyl styrene, vinyl toluene, p-tertiary butyl styrene, 1,1-diphenyl ethylene and others. The styrene block unit is suitable in particular.

Specific examples of the styrene type thermoplastic elastomer includes: styrene-isoprene-butadiene-styrene block copolymer (SIBS structure); styrene-butadiene-styrene block copolymer (SBS structure); styrene-ethylene-butylene-styrene block copolymer (SEBS structure) obtained by hydrogenation of the double bonding of the butadiene of the SBS structure; styrene-isoprene-styrene block copolymer (SIS structure); styrene-ethylene-propylene-styrene block copolymer (SEPS structure) obtained by hydrogenation of the double bonding of the isoprene of the SIS structure; styrene-ethylene-ethylene-propylene-styrene block copolymer (SEEPS structure); and modified block copolymers thereof.

The content of styrene (or its derivatives) in each of the SIBS, SBS, SEBS, SIS, SEPS and SEEPS structures is preferably in a range of 10–50 wt. %, and more preferably in a range of 15–45 wt. % within the copolymer. If the content is less than 10 wt. %, the cover becomes too soft, degrading the cut resistance. If it exceeds 50 wt. %, sufficient levels of hit feeling and controllability cannot be maintained.

In the present invention, it is possible to use the copolymer of the SIBS, SBS, SEBS, SIS, SEPS or SEEPS structure having its portion modified by a functional group selected from epoxy group, hydroxyl group, acid anhydride and carboxyl group.

For example, the styrene-butadiene-styrene block copolymer (SBS structure) having a polybutadiene block containing epoxy group is a block copolymer that has a polymer chain with polystyrene at both ends and polybutadiene containing the epoxy group at the intermediate portion. It may include a part or all of the double bonding of the polybutadiene portion subjected to hydrogenation. The styrene-isoprene-styrene block copolymer (SIS structure) is a block copolymer having a polymer chain with polystyrene at both ends and polyisoprene containing the epoxy group at the intermediate portion, and a part or all of the double bonding of the polyisoprene portion may have been subjected to hydrogenation.

The epoxidized styrene type thermoplastic elastomer with an epoxy equivalent in a range from 200 to 3000 may be used. When the epoxidized thermoplastic elastomer is mixed with ionomer resin or the like, it comes to react with free carboxyl group of the ionomer resin. This increases the strength of the cover composition and improves the cut resistance still further. If the epoxy equivalent is less than 200, a sufficient level of improvement in the cut resistance cannot be expected. If it exceeds 3000, too much reaction will occur between the epoxy group and the free carboxyl group of the ionomer resin. In this case, the fluidity is degraded, making it difficult to mold the ball.

Each of the hydroxyl group, acid anhydride and carboxyl group may also be introduced into the intermediate or end portion of the polymer chain of the block copolymer.

In the cover composition of the present invention, thermoplastic resin may be blended as the polymer component in addition to the thermoplastic elastomer. Here, the thermoplastic resin may include general purpose resins such as ionomer resin, polyethylene, polypropylene, polystyrene, ABS resin, methacrylic resin, polyethylene terephthalate, ACS resin, and polyamide. Among them, the ionomer resin is preferable in particular.

A representative example of the ionomer resin is a binary copolymer of, e.g., α-olefin and α,β-unsaturated carboxylic acid having a carbon number of 3–8, obtained by neutralizing at least a portion of the carboxyl group with a metal ion. Another example of the ionomer resin is a ternary copolymer of, e.g., α-olefin, α,β-unsaturated carboxylic acid with a carbon number of 3–8 and α,β-unsaturated carboxylate having a carbon number of 2–22, obtained by neutralizing at least a portion of the carboxyl group with a metal ion.

When the base polymer of the ionomer resin is the binary copolymer of the α-olefin and α,β-unsaturated carboxylic acid having a carbon number of 3–8, it is preferable that it includes 80–90 wt. % of α-olefin and 10–20 wt. % of α,β-unsaturated carboxylic acid. When the base polymer is the ternary copolymer of the α-olefin, α,β-unsaturated carboxylic acid having a carbon number of 3–8 and α,β-unsaturated carboxylate having a carbon number of 2–22, it preferably includes: 70–85 wt. % of α-olefin; 5–30 wt. % of, or more preferably 12–20 wt. % of α,β-unsaturated carboxylic acid; and not exceeding 25 wt. % of, or more preferably 10–25 wt. % of α,β-unsaturated carboxylate. These ionomer resins preferably have a melt index (MI) of from 0.1 to 20, and more preferably from 0.5 to 15. By setting the content of carboxylic acid or carboxylate within the foregoing range, it is possible to increase the resilience performance.

The α-olefin may include ethylene, propylene, 1-butene and 1-pentene. Ethylene is particularly preferable among them. The α,β-unsaturated carboxyl acid having a carbon number of 3 to 8 may include acrylic acid, methacrylic acid, fumaric acid, maleic acid, crotonic acid and others. Among them, acrylic acid and methacrylic acid are preferable in particular. The unsaturated carboxylate may include methyl, ethyl, propyl, n-butyl and isobutyl ester of acrylic acid, methacrylic acid, fumaric acid, maleic acid and others. Among them, acrylate and methacrylate are preferable particularly.

As the metal ion for use in neutralizing at least a portion of the carboxyl group included in the binary copolymer of the α-olefin and α,β-unsaturated carboxylic acid or in the ternary copolymer of the α-olefin, α,β-unsaturated carboxylic acid and α,β-unsaturated carboxylate, sodium ion, lithium ion, zinc ion, magnesium ion, potassium ion or the like may be utilized. When the ionomer resin is a copolymer of ethylene and acrylic or methacrylic acid having at least a portion of carboxyl group neutralized with a metal ion, it is preferably of a high-rigidity and high-flow type, having a melt index of 3–7 and a flexural rigidity of 200–400 MPa.

To enumerate specific examples of the ionomer resin above, those of the binary copolymer type are available from Du Pont-Mitsui Chemical Co., Ltd. under the trade names of Hi-milan 1555 (Na), Hi-milan 1557 (Zn), Hi-milan 1605 (Na), Hi-milan 1706 (Zn), Hi-milan 1707 (Na), Hi-milan AM 7318 (Na), Hi-milan AM 7315 (Zn), Hi-milan AM 7317 (Zn), Hi-milan AM 7311 (Mg), and Hi-milan MK 7320 (K), and those of the ternary copolymer type under the trade names of Hi-milan 1856 (Na), Hi-milan 1855 (Zn), and Hi-milan AM 7316 (Zn). Further, the ionomer resins of the binary copolymer type are available from Du Pont Co., Ltd. under the trade names of Surlyn 8945 (Na), Surlyn 8940 (Na), Surlyn 9910 (Zn), Surlyn 9945 (Zn), Surlyn 7930 (Li), and Surlyn 7940 (Li), and those of the ternary copolymer type under the trade names of Surlyn AD 8265 (Na) and Surlyn AD 8269 (Na).

The ionomer resins available from Exxon Corp. include IOTEC 7010 (Zn) and IOTEC 8000 (Na). Na, Zn, K, Li, Mg and others within the parentheses following the trade names of the ionomer resins above represent metal ions used for neutralization thereof. In the present invention, a mixture of at least two of the ionomer resins enumerated above may be employed as the ionomer resin to be blended in the cover composition. Alternatively, a mixture of at least two of the ionomer resins selected from those neutralized with monovalent metal ions and those neutralized with bivalent metal ions may be employed.

The polymer component of the cover composition of the present invention preferably includes thermoplastic elastomer as its main component. In other words, the thermoplastic elastomer is blended at least 50 parts by weight, and preferably at least 60 parts by weight, with respect to 100 parts by weight of the polymer component. This allows spin performance of a high level to be maintained. It is also possible that the thermoplastic elastomer accounts for the entirety of the polymer component.

When the thermoplastic resin such as the ionomer resin is mixed in the thermoplastic elastomer, rigidity of an appropriate level is added to the cover composition, resulting in good hit feeling. In particular, if the ionomer resin is mixed with styrene type or urethane type thermoplastic elastomer modified by the functional group, reaction or interaction of the carboxyl group of the ionomer resin with the modifying functional group or the like leads to improvement in cut resistance while maintaining the good resilience performance of the cover composition. Herein, if the ionomer resin is being used as the thermoplastic resin, the ionomer resin (X component) is mixed to the thermoplastic elastomer (Y component) with a weight ratio (X component/Y component) of not greater than 50/50.

The organic short fiber for use in the present invention may include nylon fiber, acrylic fiber, polyester fiber, aramid fiber and others. In order to improve the cut resistance without degrading the resilience performance, the nylon fiber or the aramid (Kevlar) fiber is particularly preferable. If inorganic short fiber such as fibrous aluminum borate whisker is used instead of the organic short fiber, a difference in elastic modulus between the inorganic short fiber and the cover base material becomes too large. In such a case, the inorganic short fiber cannot follow the deformation of the cover base material surrounding it when the golf ball is hit. This increases energy loss at the interface therebetween, thereby degrading the resilience performance. By comparison, when the organic short fiber is used, the elastic modulus of the organic short fiber is similar to that of the cover base material, so that the energy loss is small.

In the present invention, when mixing the organic short fiber with the thermoplastic elastomer, affinity of the organic short fiber and the thermoplastic elastomer can be increased employing a so-called master-batch method to improve adhesion therebetween. Specifically, when the aramid (Kevlar) fiber is being used, the aramid fiber is subjected to surface treatment with epoxy resin, resorcin-formaldehyde resin or the like, mixed with the thermoplastic elastomer, and then pelletized.

The organic short fiber has a length in a range of 5–1000 $\mu$m, and preferably in a range of 10–500 $\mu$m, and a diameter in a range of 0.05–5 $\mu$m, and preferably in a range of 0.1–1 $\mu$m. If the length of the fiber is shorter than the foregoing range, it is weak in the bending direction, the strength is not increased, so that cut resistance cannot be improved. If the diameter is shorter than the foregoing range, the fiber would work just as a filler. On the contrary, if the length and the diameter of the fiber exceed the ranges above, viscosity of the cover material increases, degrading the moldability. In the present invention, the organic short fiber is a concept that includes fiber cut into pieces to obtain pulp.

The organic short fiber is blended preferably 0.5–20 parts by weight, more preferably 1–15 parts by weight, and most preferably 3–10 parts by weight, with respect to 100 parts by weight of the polymer component in the cover composition. If the blended amount is less than 0.5 parts by weight, the effect resulting from blending the organic short fiber is small. If it exceeds 20 parts by weight, viscosity of the cover composition increases, which leads to degradation in moldability and the cover will crack easily. When short fiber-reinforced polymer is employed, the amount of the organic short fiber to be blended in the cover composition is set within the foregoing range, with the polymer component included in the short fiber-reinforced polymer being added to the polymer component of the cover composition.

In the present invention, it is possible to premix a prescribed amount of the organic short fiber in polymer of rubber or the like to obtain organic short fiber-reinforced polymer, which can be kneaded into the cover base material. In this case, the organic short fiber is mixed and dispersed uniformly within the cover base material, so that the cut resistance is further improved. Herein, as the polymer to which the organic short fiber is being mixed, rubber such as natural rubber, butadiene rubber, styrene butadiene rubber, NBR, EPDM, silicone rubber and epichlorohydrin rubber, resin such as low-density polyethylene, or a mixture thereof can be employed. The blended amount of the organic short fiber in the short fiber-reinforced polymer is set in a range of 20–100 parts by weight, preferably 20–70 parts by weight, and more preferably 30–55 parts by weight, with respect to 100 parts by weight of the polymer within the short fiber-reinforced polymer. It is understood that the polymer component within the cover composition refers to the ionomer resin, thermoplastic elastomer, rubber and others as the base materials, and it does not include the organic short fiber.

The cover composition of the present invention is obtained as desired by adding a prescribed amount of the organic short fiber to the thermoplastic elastomer, such as the styrene type thermoplastic elastomer having SBS, SIS or other structure or the urethane type thermoplastic elastomer, and the thermoplastic resin such as the ionomer resin, and mixing them under heat. The heating and mixing is usually conducted with an internal mixer such as a two-axis kneading type extruder, Banbury or kneader, at a temperature of, e.g., 150–260° C.

The cover composition of the present invention has a Shore D hardness, measured at the surface of the golf ball, of from 41 to 56, and preferably from 41 to 50. If the Shore D hardness is less than 41, it becomes too soft, so that cut resistance is degraded. If it exceeds 56, the hit feeling becomes hard, and spin rate when hit is decreased. Here, the Shore D hardness was measured according to ASTMD-2240.

Further, the cover composition of the present invention preferably has a flexural rigidity in a range from 80 MPa to 300 MPa. If it is less than 80 MPa, cut resistance is degraded. If it exceeds 300 MPa, the spin rate is decreased, and the hit feeling would become hard. Here, the flexural rigidity was measured according to JIS K7106 with the cover composition press-molded into a flat plate of 2 mm thick.

In the cover composition of the present invention, various kinds of additives may also be blended, where appropriate, to the extent that they would not impair the desired characteristics of the cover composition as a cover of the golf ball. The additives include filler such as barium sulfate, colorant such as titanium dioxide, dispersant, antioxidant, UV absorbent, photo-stabilizer, and fluorescent material or fluorescent brightening agent.

The present invention is applicable to both the thread-wound ball and the solid ball, employing a thread-wound core and a two-piece or three-piece core for the solid ball, respectively. The core of the solid ball is formed of cross-linked structures of a rubber composition. As a rubber component of the rubber composition, one including butadiene rubber having a cis-1,4-structure as the base material is suitable. Alternatively, a rubber component having, besides the butadiene rubber, natural rubber, styrene butadiene rubber, isoprene rubber, chloroprene rubber, butyl rubber, ethylene propylene rubber, ethylene propylene diene rubber, or acrylonitrile rubber blended not greater than 40 parts by weight with respect to 100 parts by weight of the rubber component may be utilized.

As a crosslinking agent for the rubber composition, those commonly used may be employed. They include: metallic salt of $\alpha,\beta$-ethylene type unsaturated carboxylic acid, such as zinc acrylate and zinc methacrylate, that is obtained by causing $\alpha,\beta$-ethylene type unsaturated carboxylic acid, such as acrylic acid or methacrylic acid, and metal oxide, such as zinc oxide, to react with each other during preparation of the rubber composition; polyfunctional monomer; N,N'-phenyl bis maleimide; sulfur; and others. Among them, the metallic salt of $\alpha,\beta$-ethylene type unsaturated carboxylic acid, especially zinc salt, is preferable.

In the case of the metallic salt of $\alpha,\beta$-ethylene type unsaturated carboxylic acid, for example, it is preferably blended 20–40 parts by weight with respect to 100 parts by weight of the rubber component. In the case where the α,β-ethylene type unsaturated carboxylic acid and the metal oxide are being reacted with each other during preparation of the rubber composition, it is preferable that the α,β-ethylene type unsaturated carboxylic acid is blended 15–30 parts by weight with respect to 100 parts by weight of the rubber component, and that the metal oxide such as zinc oxide is blended 15–35 parts by weight with respect to 100 parts by weight of the relevant α,β-ethylene type unsaturated carboxylic acid.

As a filler for the rubber composition for the core, one or at least two types of inorganic powder, such as barium sulfate, calcium carbonate, clay, zinc oxide and others, may be employed. The blended amount of the filler is preferably in a range of 5–50 parts by weight with respect to 100 parts by weight of the rubber component.

Besides the additives described above, a softener or liquid rubber may be blended where appropriate for the purposes of improving the workability and adjusting the hardness. An antioxidant may also be blended.

As a crosslink initiator, an organic peroxide, such as dicumyl peroxide, 1,1-bis (t-butyl peroxy) 3,3,5-trimethyl cyclohexane, may be employed. The blended amount of the crosslink initiator is preferably 0.1–5 parts by weight, and more preferably 0.3–3 parts by weight, with respect to 100 parts by weight of the rubber component.

In the present invention, the core may be made of a single layer or multiple layers different in properties like specific gravity and hardness. In such a case, the ingredients of the core are not limited to those described above.

In preparation of the core, the ingredients are mixed using a roll, kneader, Banbury or the like, and vulcanized in a mold under pressure for 10–40 minutes, at a temperature of 145–200° C., and more preferably 150–175° C. An adhesive may be applied to the surface of the obtained core, or the surface may be roughened, to improve adhesion between the core and the cover.

Here, the thread-wound or solid core is designed to have a diameter of 36.8–41.4 mm, and more preferably 37.8–40.8 mm. If the diameter is less than 36.8 mm, the cover layer becomes too thick, so that resilience performance is degraded. If it exceeds 41.4 mm, the cover layer becomes too thin, making molding difficult.

In the present invention, conventional methods can be employed to cover the core with the cover. The cover composition may be preformed into a hemispherical half shell. The core is then enveloped with two such half shells, and press-molded at 130–170° C. for 1–5 minutes. Alternatively, the cover composition may be injection-molded directly on the core to envelop the core. The thickness of the cover is preferably 0.7–3.0 mm, and more preferably 1.0–2.5 mm. If it is less than 0.7 mm, the cover will easily crack when the ball is hit repeatedly. If it exceeds 3.0 mm, the hit feeling is degraded. During the molding of the cover, a large number of dimples may be formed on the surface as necessary. The golf ball of the present invention usually undergoes paint-coating and mark-stamping processes before being brought to the market, for the purposes of improving the aesthetic appearance and thus increasing the commercial value thereof.

The cover of the present invention may be formed of a single layer or a plurality of layers. The golf ball of the present invention is usually designed to have a ball diameter of 42.67–43.00 mm and a ball weight of 45.00–45.93 g.

EXAMPLES

Examples 1–9 and Comparative Examples 1–5

(1) Production of Thread-Wound Core

In each example, a rubber composition for a core having butadiene rubber as its main component was kneaded and hot-pressed in a mold at a prescribed temperature for a prescribed period of time, to prepare a core having a diameter of 28 mm. A rubber thread was wound around the core in an elongated state, to make a thread-wound core having a diameter of 40 mm.

(2) Preparation of Cover Composition

The ingredients of the respective cover compositions are shown in Table 1 below. In Table 1, the blended amounts are expressed in parts by weight. Each rubber composition for the cover was extruded with a two-axis kneading type extruder at a cylinder temperature of 180° C. It is important that the temperature at the time of extrusion does not exceed the melting point of the organic short fiber. The conditions for the extrusion were as follows.

Screw diameter: 45 mm

Screw rotation speed: 200 rpm

Screw L/D: 35

The ingredients were heated to 195–205° C. at the position of the die of the extruder.

Using the respective cover composition, hemispherical half shells were injection-molded. The core was enveloped with two such half shells, and subjected to compression molding under pressure and heat at 150° C. in a mold. The golf ball was taken out after cooling, and the surface was coated with paint. The golf ball having a diameter of 42.8 mm and a weight of 45.4 g was thus manufactured.

Flexural rigidity of the cover composition, and cover hardness, resilience performance, cut resistance and spin performance of the golf ball were then evaluated.

The physical properties of the golf balls were evaluated in the following manner.

(1) Spin Performance (Anti-Flier Characteristic)

A spin rate P1 immediately after hitting the golf ball put on a tee with a pitching wedge and a spin rate P2 immediately after hitting the golf ball from the rough of 4 cm deep were measured. (P2/P1)×100 was calculated to evaluate the anti-flier characteristic. The results are shown in indices with respect to the value of Comparative example 1 set to 100. The index closer to 100 indicates less likeliness of the flier shot. The anti-flier characteristic is shown as an average of the results obtained by 10 skilled players.

(2) Resilience Performance

A cylindrical body made of aluminum was struck out at a speed of 45 m/s to hit the golf ball placed in front thereof. The speeds of the cylindrical body and the ball before and after the collision were read by means of a laser and calculated. The results are shown in indices with respect to the value of Example 1 being set to 100.

(3) Cut Resistance

The golf ball was hit with a pitching wedge to intentionally cut the surface. The size of the cut was evaluated in five grades. The grade 5 means that there was almost no cut. The grade 1 means that the cut was large.

TABLE 1

| | Examples | | | | | | | | | Comparative examples | | | | |
|---|---|---|---|---|---|---|---|---|---|---|---|---|---|---|
| | 1 | 2 | 3 | 4 | 5 | 6 | 7 | 8 | 9 | 1 | 2 | 3 | 4 | 5 |
| Ingredients | A | B | C | D | E | F | G | H | I | J | K | L | M | N |
| Styrene type thermoplastic elastomer*1) | 100 | 100 | 90 | 60 | — | — | — | 90 | 55 | 100 | — | — | 60 | 100 |
| Urethane type thermoplastic elastomer*2) | — | — | — | — | 100 | 70 | 50 | — | — | — | 100 | — | — | — |
| Ionomer*3) | — | — | 10 | 40 | — | 30 | 50 | 10 | 45 | — | — | 100 | 40 | — |
| Short fiber-reinforced polymer*4) | 20 | 10 | 10 | 10 | 10 | 10 | 10 | — | — | — | — | — | — | — |
| Amount of polymer component within short fiber-reinforced polymer | 13.4 | 6.7 | 6.7 | 6.7 | 6.7 | 6.7 | 6.7 | — | — | — | — | — | — | — |
| Amount of organic short fiber within short fiber-reinforced polymer | 6.6 | 3.3 | 3.3 | 3.3 | 3.3 | 3.3 | 3.3 | — | — | — | — | — | — | — |
| Kevlar pulp*5) | — | — | — | — | — | — | — | 10 | 5 | — | — | — | — | — |
| $BaSO_4$*6) | 4 | 4 | 4 | 4 | 4 | 4 | 4 | 4 | 4 | 4 | | 4 | 4 | — |
| Pigment*7) | 2 | 2 | 2 | 2 | 2 | 2 | 2 | 2 | 2 | 2 | 2 | 2 | 2 | 2 |
| Aluminum borate whisker*8) | — | — | — | — | — | — | — | — | — | — | — | — | — | 10 |
| Total amount of polymer component (A) within cover composition | 113.4 | 106.7 | 106.7 | 106.7 | 106.7 | 106.7 | 106.7 | 100 | 100 | 100 | 100 | 100 | 100 | 100 |
| Amount of organic short fiber (B) within cover composition | 6.6 | 3.3 | 3.3 | 3.3 | 3.3 | 3.3 | 3.3 | 10 | 5 | — | — | — | — | — |
| B/A | 0.058 | 0.031 | 0.031 | 0.031 | 0.031 | 0.031 | 0.031 | 0.100 | 0.050 | — | — | — | — | — |

*1)Thermoplastic elastomer (SEPS), trade name: HG 252, available from Kuraray Co., Ltd.
*2)Urethane type thermoplastic elastomer, trade name: ET 890, available from Takeda Badische Urethane Industries Ltd.
*3)Mixture of Surlyn 8945 and Surlyn 9945, available from Du Pont Co., Ltd., in equal quantity
Surlyn 8945: ethylene-methacrylic acid copolymer type ionomer resin neutralized with sodium ion, MI = 4.8
Surlyn 9945: ethylene-methacrylic acid copolymer type ionomer resin neutralized with zinc ion, MI = 5.2
*4)Nylon short fiber-reinforced polymer, LA 1060, available from Ube Industries, Ltd. natural rubber/low-density polyethylene/nylon 6 short fiber = 100/75/87 (in weight ratio), diameter of organic short fiber: 0.2 $\mu$m, content of organic short fiber within short fiber-reinforced polymer: 33.2 wt. %
*5)Aramid short fiber, available from Du Pont-Toray Co., Ltd., cut into pieces to obtain short fiber
*6)Barium sulfate BMH, available from Sakai Chemical Co., Ltd.
*7)Titanium oxide A 220, available from Ishihara Sangyou Kaisha Ltd.
*8)ALBOREX Y3A, available from Shikoku Chemicals Corporation (processed with amino silane type coupling agent).

TABLE 2

| | | Examples | | | | | | | | | Comparative examples | | | | |
|---|---|---|---|---|---|---|---|---|---|---|---|---|---|---|---|
| | | 1 | 2 | 3 | 4 | 5 | 6 | 7 | 8 | 9 | 1 | 2 | 3 | 4 | 5 |
| Ingredients of Cover composition | | A | B | C | D | E | F | G | H | I | J | K | L | M | N |
| Hardness | (Shore D) | 43 | 41 | 44 | 50 | 41 | 47 | 53 | 53 | 55 | 39 | 40 | 60 | 47 | 42 |
| Flexural rigidity | (MPa) | 91 | 82 | 107 | 156 | 84 | 131 | 178 | 170 | 190 | 68 | 71 | 241 | 142 | 72 |
| Resilience performance | (Index) | 100 | 102 | 108 | 118 | 102 | 110 | 117 | 107 | 118 | 100 | 102 | 126 | 119 | 98 |
| Cut resistance | (Grade) | 4 | 4 | 4 | 5 | 4 | 5 | 5 | 5 | 4 | 1 | 1 | 5 | 3 | 3 |
| Spin performance | (Index) | 92 | 95 | 89 | 73 | 91 | 78 | 67 | 82 | 69 | 100 | 96 | 32 | 52 | 95 |

Table 2 shows results of measurement of properties of the golf balls for Examples 1–9 and Comparative examples 1–5.

Comparative examples 1 and 2 each employ a cover composition having thermoplastic elastomer as the polymer component in which organic short fiber is not blended. They are excellent in spin performance, but considerably inferior in cut resistance.

Comparative example 3 employs a cover composition having ionomer resin as the polymer component in which organic short fiber is not blended. Comparative example 4 employs a cover composition having a mixture of thermoplastic elastomer and ionomer resin as the polymer component in which organic short fiber is not blended. They both are inferior in spin performance.

Comparative example 5 employs a cover composition having thermoplastic elastomer as the polymer component in which inorganic short fiber of aluminum borate whisker is blended. It is inferior in resilience performance.

Examples 1–7 each employ a cover composition having fiber-reinforced polymer blended therein, and Examples 8 and 9 each employ a cover composition having Kevlar pulp as organic short fiber blended therein. They all are superior in resilience performance, cut resistance and spin performance on the whole. Further, Examples 3, 4, 6, 7, 8 and 9 each have ionomer resin blended in the polymer component. Although they are slightly inferior to Examples 1, 2 and 5 in spin performance, they are at the same level as or slightly superior to those in cut resistance.

As explained above, according to the present invention, the cover composition includes a polymer component having thermoplastic elastomer as its main component, and also having thermoplastic resin where appropriate, to which organic short fiber is blended in a prescribed amount. Accordingly, a golf ball can be obtained which is easy to give a spin at the time of hitting with an ion club from the rough and also excellent in cut resistance, while maintaining good resilience performance.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf ball comprising a core and a cover surrounding the core, wherein said cover is formed of a composition containing organic short fiber blended in a polymer component which includes a thermoplastic elastomer as its main component, wherein said organic short fiber has a length in a range of 5–1000 $\mu$m (a) wherein said organic short fiber is blended in an amount of 0.5–20 parts by weight with respect to 100 parts by weight of the polymer component in said cover composition; and (b) wherein said cover composition has a flexural rigidity in the range of 80 MPa and 300 MPa.

2. The golf ball according to claim 1, wherein said thermoplastic elastomer is selected from the group consisting of a styrene containing thermoplastic elastomer and a urethane containing thermoplastic elastomer.

3. The golf ball according to claim 1, wherein the thermoplastic elastomer is blended in an amount of at least 50 parts by weight with respect to 100 parts by weight of the polymer component in said cover composition.

4. The golf ball according to claim 1, wherein said cover composition has a Shore D hardness at the surface of the cover in the range of 41 and 56.

5. The golf ball according to claim 1, wherein said organic short fiber has a length in a range of 10–500 $\mu$m.

6. The golf ball of claim 1, wherein the organic short fiber has a diameter in the range of 0.05–5.0 $\mu$m.

7. The golf ball of claim 1 wherein the organic short fiber has a diameter in the range of 0.1–1.0 $\mu$m.

* * * * *